US008989607B2

(12) United States Patent
Ueno et al.

(10) Patent No.: US 8,989,607 B2
(45) Date of Patent: Mar. 24, 2015

(54) THERMAL FIXING DEVICE AND IMAGE FORMING APPARATUS INCLUDING SAME WHICH DETECTS THE SPEED OF A BELT ON THE OUTER SURFACE OF A FIXING MEMBER

(75) Inventors: Satoshi Ueno, Tokyo (JP); Masanao Ehara, Kanagawa (JP); Tadashi Ogawa, Tokyo (JP); Hiroshi Seo, Kanagawa (JP); Takamasa Hase, Kanagawa (JP); Shuutaroh Yuasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 307 days.

(21) Appl. No.: 13/049,330

(22) Filed: Mar. 16, 2011

(65) Prior Publication Data

US 2011/0229161 A1 Sep. 22, 2011

(30) Foreign Application Priority Data

Mar. 16, 2010 (JP) ..... 2010-058724

(51) Int. Cl.
*G03G 15/20* (2006.01)

(52) U.S. Cl.
CPC ..... *G03G 15/205* (2013.01); *G03G 15/2053* (2013.01); *G03G 2215/2025* (2013.01)
USPC ..... 399/33; 399/49

(58) Field of Classification Search
USPC ..... 399/33, 67, 49
See application file for complete search history.

(56) References Cited

U.S. PATENT DOCUMENTS

| | | | | |
|---|---|---|---|---|
| 3,973,845 | A | 8/1976 | Lindblad et al. | |
| 6,681,095 | B1 * | 1/2004 | Tsuda | 399/341 |
| 7,266,336 | B2 | 9/2007 | Ueno et al. | |
| 7,343,119 | B2 * | 3/2008 | Matsuda et al. | 399/167 |
| 7,450,872 | B2 | 11/2008 | Ueno et al. | |
| 7,491,917 | B2 | 2/2009 | Ueno | |
| 7,509,085 | B2 | 3/2009 | Yoshinaga et al. | |
| 7,693,439 | B2 | 4/2010 | Seo et al. | |
| 7,715,774 | B2 | 5/2010 | Ueno | |
| 7,734,208 | B2 | 6/2010 | Seo et al. | |
| 7,742,714 | B2 | 6/2010 | Shinshi et al. | |

(Continued)

FOREIGN PATENT DOCUMENTS

| | | | |
|---|---|---|---|
| JP | 51-109739 | | 9/1976 |
| JP | 63298362 | A * | 12/1988 |

(Continued)

OTHER PUBLICATIONS

Computer translation of JP2005-094864A, Apr. 2005, to Sato.*

(Continued)

*Primary Examiner* — Quana M Grainger
(74) *Attorney, Agent, or Firm* — Oblon, McClelland, Maier & Neustadt, L.L.P.

(57) ABSTRACT

A thermal fixing device includes a fixing member, a flexible endless belt, a flexible endless belt, a rotary pressure member, a heating unit, and a rotation detector. The flexible endless belt is disposed on an outer circumferential surface of the fixing member. The rotary pressure member is disposed parallel to and pressing against the fixing member via the endless belt. The heating unit heats the endless belt. The rotation detector detects a rotation speed of the endless belt. The heating unit is powered off when the rotation speed of the endless belt detected by the rotation detector is at or below a predetermined threshold value.

6 Claims, 6 Drawing Sheets

(56) References Cited

U.S. PATENT DOCUMENTS

| | | | | |
|---|---|---|---|---|
| 7,778,581 | B2 | 8/2010 | Seo et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,817,952 | B2 | 10/2010 | Seo et al. | |
| 7,885,590 | B2 | 2/2011 | Seo et al. | |
| 2006/0029411 | A1 | 2/2006 | Ishii et al. | |
| 2007/0003334 | A1 | 1/2007 | Shinshi et al. | |
| 2007/0014600 | A1 | 1/2007 | Ishii et al. | |
| 2007/0166067 | A1* | 7/2007 | Noguchi et al. | 399/69 |
| 2007/0280754 | A1 | 12/2007 | Ogawa et al. | |
| 2008/0025773 | A1 | 1/2008 | Ito et al. | |
| 2008/0063443 | A1 | 3/2008 | Yoshinaga et al. | |
| 2008/0317532 | A1 | 12/2008 | Ehara et al. | |
| 2009/0060550 | A1 | 3/2009 | Seo | |
| 2009/0123201 | A1 | 5/2009 | Ehara et al. | |
| 2009/0245897 | A1 | 10/2009 | Seo et al. | |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0158553 | A1 | 6/2010 | Ueno | |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052277 | A1 | 3/2011 | Ueno et al. | |
| 2011/0058862 | A1 | 3/2011 | Yamaguchi et al. | |
| 2011/0058863 | A1 | 3/2011 | Shinshi et al. | |

FOREIGN PATENT DOCUMENTS

| | | | | |
|---|---|---|---|---|
| JP | 04173638 | A | * | 6/1992 |
| JP | 05319609 | A | * | 12/1993 |
| JP | 8-22206 | | | 1/1996 |
| JP | 2516886 | | | 4/1996 |
| JP | 2673959 | | | 7/1997 |
| JP | 2000-131995 | | | 5/2000 |
| JP | 2001-203072 | | | 7/2001 |
| JP | 2002-008845 | | | 1/2002 |
| JP | 2003-015445 | | | 1/2003 |
| JP | 2005094864 | A | * | 4/2005 |
| JP | 2007248923 | A | * | 9/2007 |
| JP | 2007-264421 | | | 10/2007 |
| JP | 2008-176324 | | | 7/2008 |
| JP | 4302465 | | | 5/2009 |

OTHER PUBLICATIONS computer translation of JP2002-008845A, to Abe et al.; Jun. 1992.*
U.S. Appl. No. 12/876,589, filed Sep. 7, 2010, Masanao Ehara, et al.
U.S. Appl. No. 12/923,272, filed Sep. 13, 2010.
U.S. Appl. No. 12/881,862, filed Sep. 14, 2010, Masanao Ehara, et al.
U.S. Appl. No. 12/881,547, filed Sep. 14, 2010, Naoki Iwaya, et al.
U.S. Appl. No. 12/893,361, filed Sep. 29, 2010, Kenichi Hasegawa, et al.
U.S. Appl. No. 12/946,276, filed Nov. 15, 2010, Masaaki Yoshikawa, et al.
U.S. Appl. No. 12/946,347, filed Nov. 15, 2010, Kenji Ishii, et al.
U.S. Appl. No. 13/026,945, filed Feb. 14, 2011, Kenji Ishii, et al.
Japanese Office Action mailed Oct. 22, 2013 for Japanese Patent Application No. 2010-058724.

* cited by examiner

NORMAL

FAULTY

THERMAL FIXING DEVICE AND IMAGE FORMING APPARATUS INCLUDING SAME WHICH DETECTS THE SPEED OF A BELT ON THE OUTER SURFACE OF A FIXING MEMBER

CROSS-REFERENCE TO RELATED APPLICATIONS

The present patent application claims priority pursuant to 35 U.S.C. §119 from Japanese Patent Application No. 2010-058724, filed on Mar. 16, 2010 in the Japan Patent Office, which is hereby incorporated herein by reference in its entirety.

BACKGROUND

1. Field

Exemplary embodiments of the present disclosure relate to a thermal fixing device and to an image forming apparatus, such as a copier, a printer, a facsimile machine, or a multifunctional device having at least two of the foregoing capabilities employing the image forming apparatus.

2. Description of the Background Art

Related-art image forming apparatuses, such as copiers, facsimile machines, printers, or multifunction apparatuses having at least one of copying, printing, scanning, and facsimile functions, typically form an image on a recording medium according to image data. In such an image forming apparatus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Recently, there is increased market demand for high-speed, energy-efficient image forming apparatuses. In order to achieve such required performance, it is important to enhance the heating efficiency of the fixing device used in the image forming apparatus. In such an image forming apparatus, the fixing device may include contact heating systems such as a heating roller system, a film heating system, or an electromagnetic induction heating system.

For example, thermal fixing devices employing a heating roller system basically have a pair of rollers: a fixing roller and a pressure roller. The fixing roller has a heat source, e.g., a halogen lamp, therein and is maintained at a predetermined temperature by the heat source. The pressure roller, which provides the rotational force to rotate the fixing member, is pressed against the fixing roller to form the pair of rollers (for example, see JP-2000-131995-A). A recording material bearing an unfixed toner image is introduced into a contact portion, i.e., a nip between the pair of rollers and heat and pressure are applied to fix the toner image on the recording material.

For fixing devices employing a film-heating system, the recording material comes into close contact with a heating member fixedly supported by a support member via a thin, heat-resistant rotatable fixing film. While sliding the fixing film over the heating member, heat from the heating member is transferred to the recording material via the fixing film (for example, see JP-S63-313182-A and JP-H01-263679-A). In the film-heating fixing device, the heating member may be, for example, a ceramic heater including a resistive layer formed on a ceramic substrate made of alumina or aluminum nitride having properties, such as heat resistance, insulating properties, and high thermal conductivity. Since a thin fixing film having low heat capacity can be used in the film-heating fixing device, the fixing unit has a heat transfer efficiency higher than that of the heating-roller fixing device. Such a configuration can shorten warm-up time, thus allowing quick starts and saving energy.

Fixing devices employing an electromagnetic induction-heating system use a technique in which Joule heat is generated by an eddy current generated in a metallic layer (heat generation layer) of a fixing sleeve using magnetic flux (for example, see JP-H08-022206-A, JP-S51-109739-A, and JP-4302465-B). In an electromagnetic induction-heating fixing device, heat is directly generated in the fixing film using an induction current, thus achieving a more efficient fixing process than the heating-roller fixing device having a halogen lamp as the heat source.

Moreover, in the induction-heating fixing device, a high-frequency induction heating unit quickly raises the temperature of ferromagnetic material contained in an adhesive to the Curie point. Upon reaching the Curie point, the ferromagnetic material loses magnetism. As a result, the temperature of the ferromagnetic material does not rise and is maintained at a constant temperature. Since the Curie point of the ferromagnetic material is set to substantially the same temperature as the fixing temperature, the temperature of the ferromagnetic material is maintained at substantially the fixing temperature. Such a configuration can shorten the start-up time of the rotary heating member and achieve high-precision temperature control without reducing, for example, the separation performance and heat resistance of the surface of the rotary heating member, which are required for the fixing device, and without using a complicated control device.

As described above, such an electromagnetic-induction-heating fixing device may include a fixing sleeve having a release layer, an elastic layer, and a metallic layer (heat generation layer), and a fixing roller having an elastic layer and a support member (metal core). The fixing roller is enclosed in the fixing sleeve, and the fixing roller and the pressure roller are pressed against each other via the fixing sleeve to form a contact portion (referred to as a fixing nip). The fixing sleeve is rotatably provided around the outer circumferential surface of a stationary fixing member. As the pressure roller rotates, the fixing sleeve slides over the outer circumferential surface of the stationary fixing member to convey the recording material. In this configuration, the fixing sleeve is heated by induction heating or other heating methods from the inside or outside of the fixing member.

In the fixing member having the above-described configuration, a ring having a diameter larger than that of the fixing sleeve is provided at an end of the fixing roller to prevent the fixing member from shifting in a thrust direction, i.e., axial direction thereof. For the fixing device using the thin fixing sleeve as described above, typically, the heat capacity of the fixing sleeve is relatively small. Accordingly, when the heating operation is continuously performed with the fixing sleeve stopped, a heated portion in a circumferential direction of the fixing sleeve may exceed an allowable temperature limit of the fixing sleeve in a very short time (for example, in several seconds). Therefore, it is necessary to constantly rotate the fixing sleeve when it is heated and to immediately stop heating when the rotation of the fixing sleeve stops or slows down due to a malfunction. Accordingly, it is preferable that the fixing device be able to detect the rotation of the fixing sleeve or the fixing roller.

However, for the thin fixing sleeve, it is difficult to directly detect the rotation of the thin fixing sleeve supported on the elastic layer of the fixing roller or a housing of the fixing member, and implementation of such a direct detection mechanism is costly. Therefore, conventionally, no detection is performed on the rotation of the thin fixing sleeve, or the rotation of the fixing sleeve is detected by alternative methods, such as detecting the driving force applied to the fixing device or detecting the rotation of the shaft of the fixing roller.

However, even if the fixing roller is driven without any problem and the rotation thereof is detected, for example, a failure may occur in the elastic layer or the interface between the elastic layer and the metal core of the fixing roller, causing the fixing sleeve alone to stop or slows down abnormally. In such a case, the heating unit cannot be stopped safely by the above-described conventional methods.

SUMMARY

In an aspect of this disclosure, there is provided an improved thermal fixing device including a fixing member, a flexible endless belt, a flexible endless belt, a rotary pressure member, a heating unit, and a rotation detector. The flexible endless belt is disposed on an outer circumferential surface of the fixing member. The rotary pressure member is disposed parallel to and pressing against the fixing member via the endless belt. The heating unit heats the endless belt. The rotation detector detects a rotation speed of the endless belt. The heating unit is powered off when the rotation speed of the endless belt detected by the rotation detector is at or below a predetermined threshold value.

In an aspect of this disclosure, there is provided an improved image forming apparatus including the fixing device described above.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
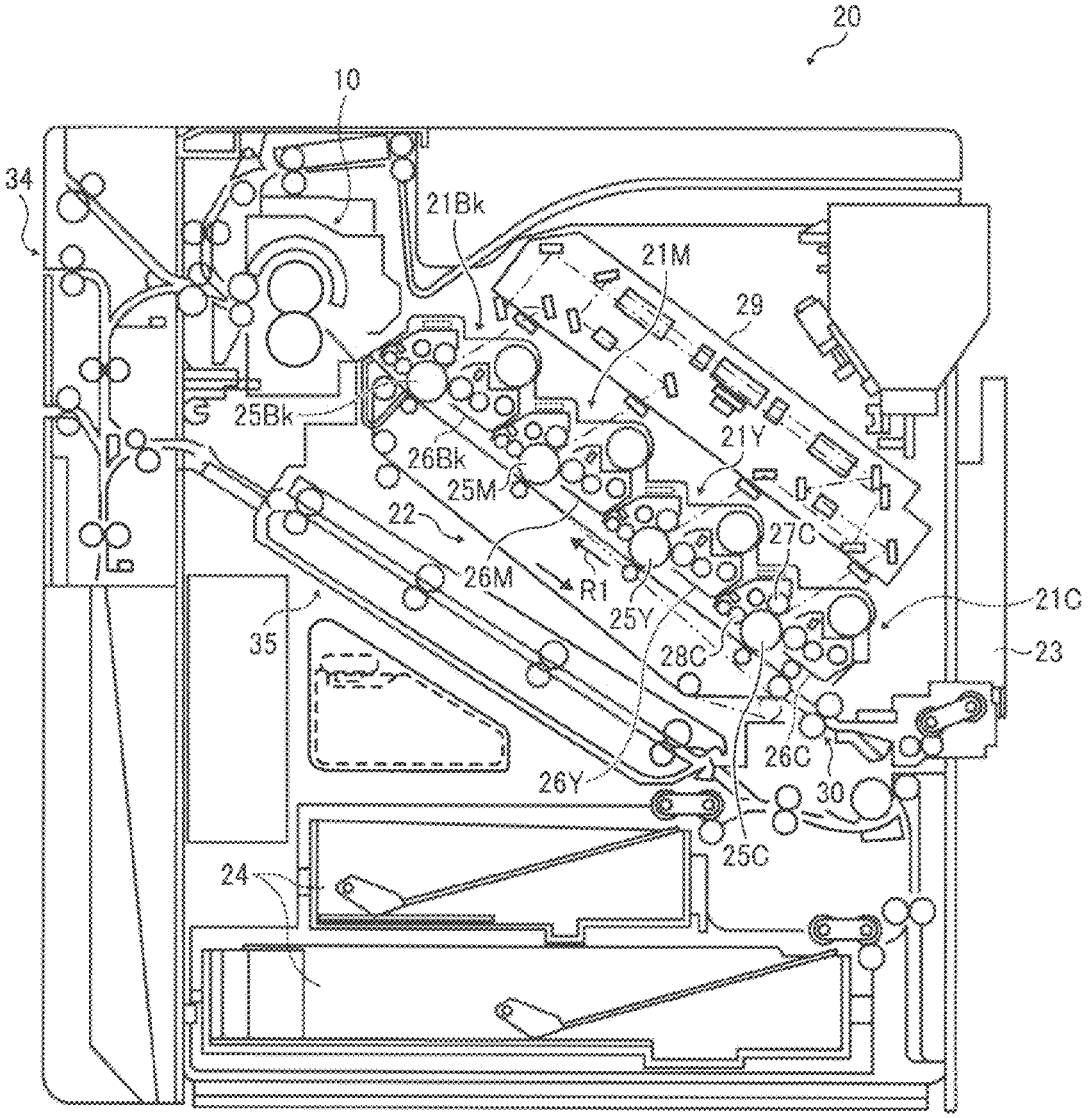
FIG. 1 is a schematic view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below with reference to FIGS. 1 to 6B.

FIG. 1 is a cross-sectional view of an image forming apparatus according to an exemplary embodiment of the present disclosure. It is to be noted that the image forming apparatus is not limited to a copier or printer having four tandemly-arranged photoconductive drums, as illustrated in FIG. 1, capable of forming a full-color image and may be an image forming apparatus capable of forming only monochrome images.

An image forming apparatus 20 illustrated in FIG. 1 transfers images of different colors in a superimposing manner onto a recording sheet, such as a sheet of paper, attached to a transfer belt serving as a transfer member. Thus, a composite color image is formed directly from a latent-image bearing member on the recording sheet. In FIG. 1, the image forming apparatus 20 includes image forming units 21Y, 21M, 21C, and 21Bk, a transfer device 22, a manual feed tray 23, two sheet cassettes 24, registration rollers 30, and a thermal fixing device 10. The image forming units 21Y, 21M, 21C, and 21Bk form images of respective colors in accordance with a document image. The transfer device 22 is disposed opposing the image forming units 21Y, 21M, 21C, and 21Bk. The manual feed tray 23 serving as a sheet feed unit feeds a recording sheet to transfer positions at which the image forming units 21Y, 21M, 21C, and 21Bk face the transfer device 22. The two sheet feed cassettes 24 are installed in a feeding device 24. The registration rollers 30 feed the recording sheet conveyed from one of the two sheet feed cassettes 24, the manual feed tray 23 in synchronization with image formation performed by the image forming units 21Y, 21M, 21C, 21B. After the image transfer at the transfer positions, the thermal fixing device (which may also be hereinafter referred to as "fixing device") 10 fixes the composite image on the recording sheet. In the present exemplary embodiment, fixing operation is performed on a recording sheet bearing an image. Alternatively, depending on transfer types, fixing operation may be performed on a transfer member contacting photoconductive members without interposing a recording medium, such as a recording sheet, therebetween. In other words, fixing operation may be performed on a medium on which transfer and fixing operations are performed at a time.

The fixing device 10 employs a fixing method using a pair of rollers. Accordingly, the fixing device 10 includes a fixing roller, a heat source to heat the fixing roller, and a pressure roller pressed against the fixing roller in contact therewith.

In the transfer device 22, a belt (hereinafter referred to as "transfer belt") serving as a transfer member is stretched between a plurality of rollers, and transfer bias units are disposed opposite photoconductive drums of the image forming units to apply transfer biases to the recording sheet. Further, at a position upstream from a transfer position of a first color, e.g., cyan in FIG. 1 in a running direction of the transfer belt indicated by an arrow R1 in FIG. 1, an attaching bias unit to apply attaching bias for attaching the recording sheet to the transfer belt is provided in such a manner that the attaching bias unit comes into contact with the transfer belt before a toner image of the first color is transferred.

In the image forming apparatus 20, the image forming units 21Y, 21YM, 21C, and 21Bk develop color toner images of yellow, magenta, cyan, and black, respectively. The image forming units 21Y, 21YM, 21C, and 21Bk have substantially the same configurations except different colors of toners used. Therefore, the configuration of the image forming unit 21C is described below as a representative of the image forming units 21M, 21Y, and 21Bk.

The image forming unit 21C includes a photoconductive drum 25C serving as an electrostatic latent-image bearing member, a charging device 27C, a development device 26C, and a cleaning device 28C that are provided along a rotational direction of the photoconductive drum 26C (e.g., a clockwise direction in FIG. 1), and forms an electrostatic latent image between the charging device 27C and the developing device 26C with writing light emitted from a optical writing unit 29 in accordance with image data corresponding to colors separated. The electrostatic latent-image bearing member is not limited to a drum shape and may have a belt shape. In the image forming apparatus 20 illustrated in FIG. 1, the transfer device 22 extends diagonally, thus reducing the space occupied by the transfer device 22 in the horizontal direction thereof.

The image forming apparatus 20 having the above-described configuration performs image formation on the basis of the following operations and conditions. In the following description, the image forming unit 21C that forms images using cyan toner is described as a representative of the image forming units 21. The other image forming units 21Y, 21M, and 21Bk perform the image formation in the same manner.

First, during image formation, the photoconductive drum 25C is rotated by a main motor and diselectrified by an AC bias (having no DC component) supplied by the charging device 27C so that the surface potential of the photoconductive drum 25C is set at a reference potential of approximately −50V. The charging device 27C applies a DC bias superposed with an AC bias to the photoconductive drum 25C to uniformly charge the photoconductive drum 25C at a potential substantially equal to a DC component. As a result, the surface potential of the charging device 27C is charged at a target charge potential of, for example, approximately −500V to −700V, which is determined by a process control unit.

With the photoconductive drum 25C uniformly charged, writing process is performed. The optical writing unit 29 writes a target image in accordance with digital image data from a controller unit to form an electrostatic latent image. For example, in the optical writing unit 29, a laser light source emits a laser beam in response to laser-diode emission signals converted into binary signals for each color in accordance with the digital image data. The laser beam passes through a cylinder lens, a polygon mirror, a fθ lens, first to third mirrors, a wide toroidal lens (WTL), and the like. The photoconductive drum bearing an image of each color (in this case, the photoconductive drum 25C) is illuminated with the laser beam. The surface potential of illuminated portions of the photoconductive drum is set to approximately −50V, thus forming an electrostatic latent image in accordance with the image data.

The electrostatic latent image formed on the photoconductive drum 25C is visualized by the development device 26C with toner of a color complementary to a separated color. In the development process, a DC bias of, fro example, approximately −300V to approximately −500V superposed with an AC bias is applied to a development sleeve to develop with toner (Q/M: −20 to −30 μC/g) an image area having a relatively low potential reduced by the illumination of the laser beam, thus forming the toner image.

A toner image of each color visualized in the developing process is transferred onto a recording sheet fed at a predetermined timing by the registration rollers 30. The attaching bias is applied to the recording sheet by the sheet attaching bias unit including the roller before the recording sheet reaches the transfer belt of the transfer device 22. Thus, the recording sheet is electrostatically attached onto the transfer belt. Each of bias transferors of the transfer device 22 disposed opposite the corresponding photoconductive drums 25 of the image forming units applies a bias having a polarity opposite that of the toner to the transfer belt. As a result, toner images on the photoconductive drums are electrostatically transferred onto the recording sheet electrostatically attracted to the transfer belt and conveyed with the transfer belt.

After the transfer processes of four color images are finished, the recording sheet is smoothly separated from the transfer belt by a curvature of a driving roller of the transfer device 22, and conveyed to the fixing device 10. When the recording sheet bearing the toner image passes through a fixing nip formed between the fixing roller and the pressure roller, the toner image is fixed on the recording sheet. For a single-side image formation, the recording sheet is ejected to an external sheet tray or an internal sheet tray.

The image forming apparatus 20 illustrated in FIG. 1 can perform double-side image formation on both sides of the recording sheet. In FIG. 1, when a double-side image formation mode is selected, the recording sheet having passed through the fixing device 10 is conveyed to a reversing unit 34. The first side and the second side of the recording sheet are reversed oppositely in the reversing unit 34, and the recording sheet is conveyed to a duplex conveying unit 35. As with the single-side image formation, the recording sheet conveyed from the duplex conveying unit 35 is conveyed to the registration rollers 30 and fed to the transfer positions at a predetermined timing. After the fixing device 10 fixed images on both sides of the recording sheet, the recording sheet is ejected to one of the ejection trays in the same manner as the above-described single-side image formation.

Figure 2B:
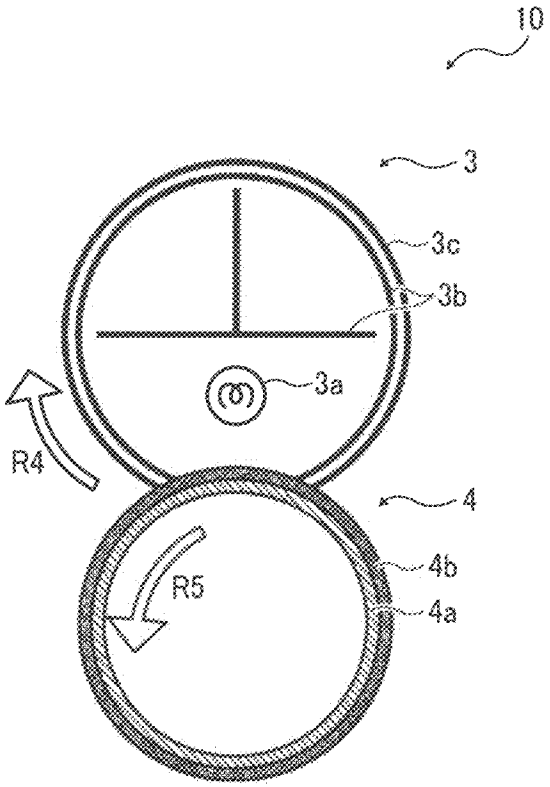
FIG. 2B is a schematic view of a fixing device according to another exemplary embodiment of the present disclosure.
Figure 2A:
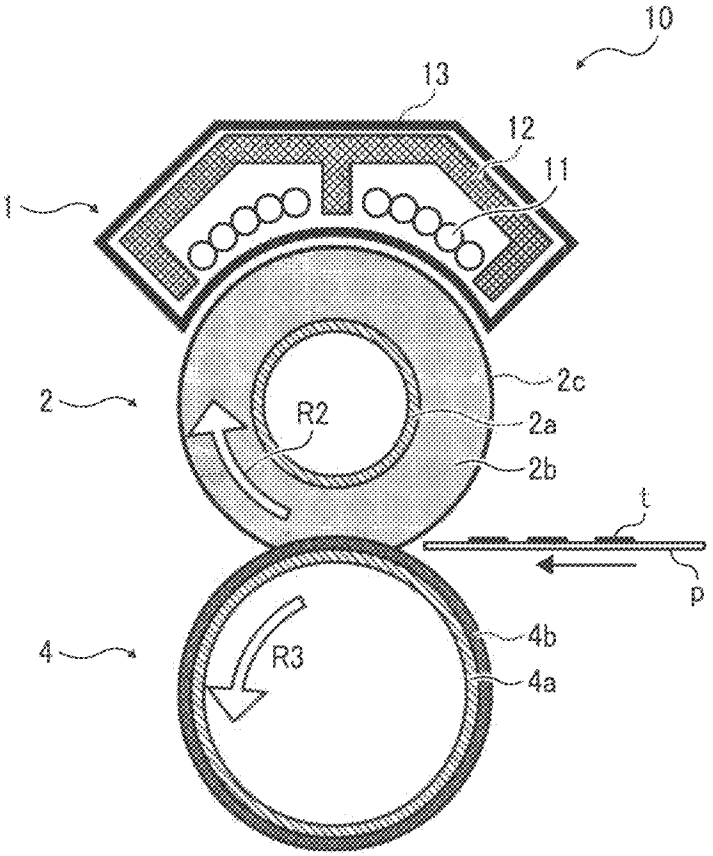
FIG. 2A is a schematic view of a fixing device according to an exemplary embodiment of the present disclosure.

FIG. 2A is a cross-sectional view of a fixing device using induction heating. As illustrated in FIG. 2A, the fixing device includes, for example, an induction heater 1 (magnetic flux generation unit) serving as a heating unit, a fixing roller 2 serving as a fixing member, and a pressure roller 4 serving as a pressure member.

In FIG. 2A, the fixing roller (rotary heat-generation member) 2 is a multi-layered roller member having a hollow metal core 2*a*, an elastic layer 2*b*, and a fixing sleeve 2*c*. The elastic layer 2*b* is formed on the surface of the hollow metal core 2*a* made of, e.g., carbon steel, and the fixing sleeve (endless belt) 2*c* is formed on the elastic layer 2*b*.The fixing sleeve 2*c* may be adhered to the elastic layer 2*b* making the fixing sleeve 2*c* an integral part of the fixing roller 2, or may not be adhered thereto.

The elastic layer 2*b* has a film thickness of approximately 2 mm to approximately 10 mm. The elastic layer 2*b* allows an appropriate nip to be formed at a contact portion between the fixing roller 2 and the pressure roller 4. Such a configuration can output a high quality fixed image and obtain a good separation performance of the recording sheet after the fixing process. Further, the elastic layer 2*b* may be a heat-insulating elastic layer. Such a configuration minimizes heat transfer from the fixing sleeve 2*c* to the elastic layer 2*b* (an inner circumferential surface side of the fixing sleeve 2*c*), thus preventing a reduction in the efficiency of raising the surface temperature of the fixing roller 2.

The fixing sleeve 2*c* is a fixing sleeve (metallic sleeve) having a heat generation layer and is heated in an area opposite the induction heater 1. The heated fixing sleeve 2*c* heats and fixes the toner image (t) on the recording medium P conveyed to the contact position (fixing nip) with the pressure roller 4. More specifically, when a high-frequency alternating current is passed through an IH (induction heating) coil unit 11 of the induction heater 1, an alternating magnetic field is formed around the IH coil unit 11. As a result, an eddy current is generated in the heat generation layer of the fixing sleeve 2*c*. When the eddy current is formed in the heat generation layer, Joule heat is generated by the electric resistance of the heat generation layer. The entire fixing sleeve 2*c* is heated by the Joule heat. The heat generation layer includes magnetic metallic material, such as steel, cobalt, nickel, or alloy thereof, and/or non-magnetic metallic material such as SUS304 or SUS316. In FIG. 2A, the induction heater unit 11 also includes a ferrite core portion 12 and an IH-coil housing 13.

The pressure roller 4 serving as the pressure member includes a cylindrical member (metal core) 4*a* of, e.g., aluminum or copper, an elastic layer 4*b* of, e.g., silicone rubber, and a release layer of, e.g., tetrafluoroethylene-perfluoroalkyl vinyl ether copolymer (PFA). The elastic layer 4*b* is formed with a thickness of approximately 1 mm to approximately 5 mm on the cylindrical member 4*a*. The release layer is formed with a film thickness of approximately 20 μm to approximately 50 μm on the elastic layer 4*b*. The pressure roller 4 is pressed against the fixing roller 2 in contact therewith. In such a configuration, the recording sheet P is conveyed to the pressure contact portion (fixing nip) between the fixing roller 2 and the pressure roller 4.

The induction heater 1 serving as the magnetic flux generation unit includes the IH coil unit (excitation coil) 11, the ferrite core unit (excitation coil core) 12, the IH coil housing 13, a cover member, and the like.

In such a configuration, the IH coil housing 13 covers a portion of the outer circumferential surface of the fixing sleeve 2*c*. The IH coil unit 11 includes litz wires formed of a bundle of thin wires. The litz wires are coiled on the IH coil housing 13 so as to extend in an axial direction of the fixing device (a direction perpendicular to the surface of a sheet on which FIG. 2A is printed. The IH coil housing 13 includes a resin material having a high degree of heat resistance, and supports the IH coil unit 11 at the side of the surface opposite to the fixing sleeve 2*c*. The ferrite core unit 12 is made of ferromagnet, such as ferrite, (having a relative magnetic permeability of, e.g., approximately 2500) and includes a center core and a side core to form an efficient magnetic flux to the heat generation layer of the fixing sleeve 2*c*. The ferrite core unit 12 is disposed opposing the IH coil unit 11 extended in the axial direction. The cover member covers the IH coil unit 11, the ferrite core unit 12, and the IH coil housing 13.

FIG. 2B is a cross-sectional view of an internal-heating-type fixing device in which a halogen heater (which may also be referred to as a halogen lamp) 3*a* serving as a heat source for heating the surface of a fixing roller 3 is provided within the fixing roller 3. In such a configuration, a fixing sleeve 3*c* slides on the outer circumferential surface of a fixing-member body 3*b* fixedly supported on a side plate of the fixing device. In the fixing device, a fixing nip is formed by the fixing roller 3 and a pressure roller 4 that rotates while contacting the fixing roller 3 with a predetermined pressure.

In FIGS. 2A and 2B, the pressure roller 4 serving as a pressure member has an elastic layer 4*b* made of, e.g., fluororubber, silicone rubber, or silicone rubber foam and a cylindrical member (metal core) 4*a* made of, e.g., aluminum or copper. The elastic layer 4*b* is formed with a thickness of, e.g., approximately 2 mm to approximately 5 mm on the cylindrical member. A release layer (having a thickness of, e.g., approximately 20 μm to approximately 50 μm) made of, e.g., PFA may be provided on the elastic layer 4*b* to reduce toner attached to the pressure roller 4.

The above-described fixing device also detects the rotation of the fixing sleeve itself more directly at lower cost than a conventional method and safely stops the heating unit even if the shaft of the fixing roller rotates at a normal speed while the rotation of the fixing sleeve is abnormally slow.

To perform such operations, the thermal fixing device (fixing device 10) according to an exemplary embodiment includes the fixing member (the fixing roller 2 or the fixing roller 3) having the endless belt (the fixing sleeve 2*c* or the fixing sleeve 3*c*) on the outer circumferential surface thereof, the pressure member (the pressure roller 4) pressed against the fixing member to form a nip therebetween, the heating unit (the induction heater 1 or the halogen heater 3*a*) to heat the endless belt, and the rotation detector (a rotation detection bladed wheel 5, a rotation sensor 6, a rotation detection roller 91, an auxiliary roller 92*a*, a rotary belt 92*b*, a retaining ring 7 and gears 5*a* and 7*a*) to detect the rotation speed of the endless belt. At least the endless belt of the fixing member is rotated, and when the rotation speed of the endless belt detected by the above-described rotation detection is determined to be at or below a predetermined threshold value, the heating mechanism unit is powered off.

For example, the fixing device 10 may have a configuration as follows. The fixing sleeve (endless belt) is adhered to the outer circumferential surface of the fixing roller. A rotary member is pressed against the surface of the fixing sleeve and rotated by a frictional force generated by the fixing roller to detect the rotation of the fixing sleeve in an indirect manner. When the rotation speed of the fixing sleeve detected by the rotational detector is determined to be less than a normal speed, the heating unit is immediately powered off (configuration A).

In such a configuration, since the fixing sleeve (endless belt) is adhered to the fixing roller, basically, the rotation of the fixing sleeve can be detected by monitoring the rotation of the shaft of the fixing roller or the driving operation of the fixing device itself. In addition, the heating unit can be safely powered off if a failure at the interface between the metal core and the elastic layer or the elastic layer of the fixing roller causes the rotation of the fixing sleeve to stop or slows down to an inappropriate speed in terms of heat tolerance while the shaft of the fixing roller continues to rotate.

Alternatively, the fixing device 10 may have the following configuration. The fixing sleeve (endless belt) is provided, without adhesion, on the outer circumferential surface of the fixing roller or the fixing member held in a fixed manner. The fixing sleeve is rotated by the rotation of the fixing roller, or the fixing sleeve rotates while sliding over the outer circumferential surface of the fixing member held in a fixed manner. A rotary member is pressed against the surface of the fixing sleeve and rotated by frictional force generated by the fixing roller to detect the rotation of the fixing sleeve in an indirect manner. When the rotation speed of the fixing sleeve detected by the above-described rotation detection is determined to be less than a normal speed (threshold value), the heating unit is immediately powered off (configuration B).

In such a configuration, the fixing sleeve (endless belt) is not adhered to the fixing member held in a fixed manner or the fixing roller. Accordingly, there is no guarantee that the fixing sleeve rotates with rotation of the fixing roller or rotates while sliding over the outer circumferential surface of the fixing member. Hence, with the above-described rotation detector, the heating unit can be safely powered off even if the rotation of the fixing sleeve stops or slows down to an inappropriate speed in terms of heat tolerance while the shaft of the fixing roller rotates or the sliding of the fixing sleeve slows down to such an inappropriate speed.

Alternatively, in the fixing device according to one of the configurations A and B, the rotary member may be a roller having a surface made of a material of a high frictional coefficient, e.g., rubber. The roller is provided outside of an area of maximum image size in the axial direction of the fixing roller and is rotated by the rotation of the fixing sleeve, allowing the rotation of the fixing sleeve to be detected.

In such a configuration, the roller of the rotation detector is pressed against a portion of the endless belt outside of the area of maximum image size in the axial direction (main scanning direction) of the endless belt. Such a configuration allows the fixing device to be designed easily in terms of the layout at a low cost. In addition, by detecting the roller rotated by the rotation of the endless belt, the rotation of the fixing member can be detected. In particular, when the surface of the roller is made of a material having a high frictional coefficient, e.g., rubber, the roller is more reliably rotated by the rotation of the fixing sleeve, thus allowing more precise detection of the rotation of the fixing sleeve.

Alternatively, in the fixing device according to one of the configurations A and B, the rotary member may be a belt made of a material having a high frictional coefficient, e.g., rubber, looped around the outer circumferential surface of the fixing sleeve. Since the rotation of the fixing sleeve is transmitted to another rotary member via the belt, the rotation of the fixing sleeve can be detected by detecting the rotation of the rotary member. When the rotation speed of the fixing sleeve detected by the rotation detection is determined to be less than a normal speed, the heating unit is immediately powered off.

In such a configuration, the rubber belt is looped around the fixing sleeve. Such a configuration increases an area in which the fixing sleeve contacts the rotation detector, allowing more precise detection of the fixing sleeve.

Alternatively, the fixing device 10 may have the following configuration. The fixing sleeve (endless belt) is provided, without adhesion, on the outer circumferential surface of the fixing roller or the fixing member held in a fixed manner. The fixing sleeve is rotated by the rotation of the fixing roller by frictional force or rotates while sliding over the outer circumferential surface of the fixing member held in a fixed manner by the frictional force of the pressure roller. In addition, a regulation ring is provided at an axial end portion of the fixing roller or the fixing member to prevent lateral shift of the endless belt. The outer circumferential shape of the regulation ring is a teeth shape in a rectangular wave form or a wave form having a curve close to the rectangular wave form. The end portion of the fixing sleeve also has the similar teeth shape. Accordingly, the teeth shapes of the regulation ring and the end portion of the fixing sleeve engage with each other, thus causing the regulation ring to be rotated by the rotation of the fixing sleeve. The rotation of the fixing sleeve is indirectly detected by detecting the rotation of the regulation ring. When the rotation speed of the fixing sleeve detected by the rotation detection is determined to be less than a normal speed, the heating unit is immediately powered off (configuration C).

Such a regulation ring is typically used in a configuration in which the fixing sleeve is not adhered to the fixing roller or the fixing member held in a fixed manner. By contrast, in the above-described configuration C, the regulation ring is used together with the fixing sleeve adhered to the fixing roller or the fixing member held in a fixed manner. Such a configuration allows the rotation of the fixing sleeve to be detected with a reduced number of components. In addition, unlike the above-described configurations A and B, the configuration C does not rely on the frictional force, thus allowing more precise detection of the rotation of the fixing sleeve.

Next, the configuration of the fixing device 10 is described with reference to FIGS. 3 to 6 in more detail. The following description is made based on the fixing device illustrated in FIG. 2A. However, it is to be noted that the fixing device may have the configuration illustrated in FIG. 2B.

Figure 3B:
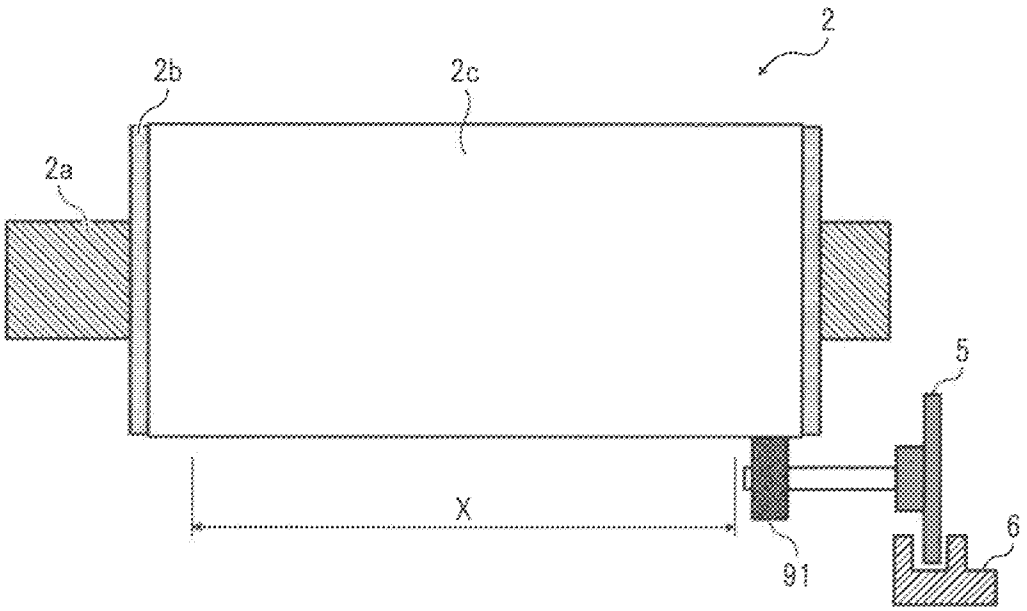
FIG. 3B is a side view of the fixing device illustrated in FIG. 3A.
Figure 3A:
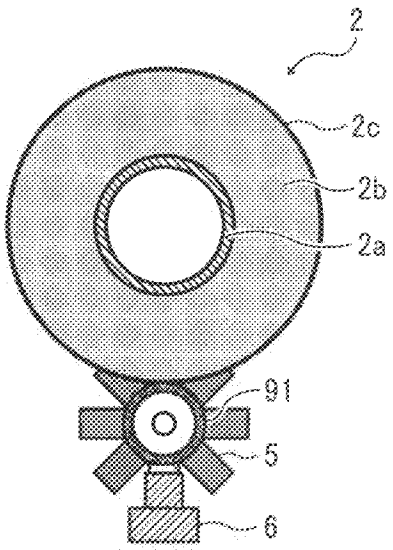
FIG. 3A is a front view of a first configuration example of a fixing device having a rotation detector to detect rotation of a fixing sleeve.

FIG. 3A is a front view of a first configuration example of a fixing device having a rotation detector to detect rotation of a fixing sleeve. FIG. 3B is a side view of the fixing device illustrated in FIG. 3A.

In such a configuration, a fixing sleeve 2*c* is adhered to an outer circumferential surface of an elastic layer 2*b*, and a rotation detection roller 91 is pressed against an end portion of the fixing sleeve 2*c* outside of an area X of maximum image size. The rotation detection roller 91 made of, e.g., rubber is rotated by frictional force generated between the fixing sleeve 2*c* and it when the fixing sleeve 2*c* rotates. A portion of a rotary bladed wheel (rotation detection bladed wheel) 5 provided coaxially with the fixing sleeve 2*c* passes through a sensor (rotation sensor) 6 at constant time intervals, thus allowing the rotation of the fixing sleeve 2*c* to be detected with the rotation sensor 6.

Figure 4B:
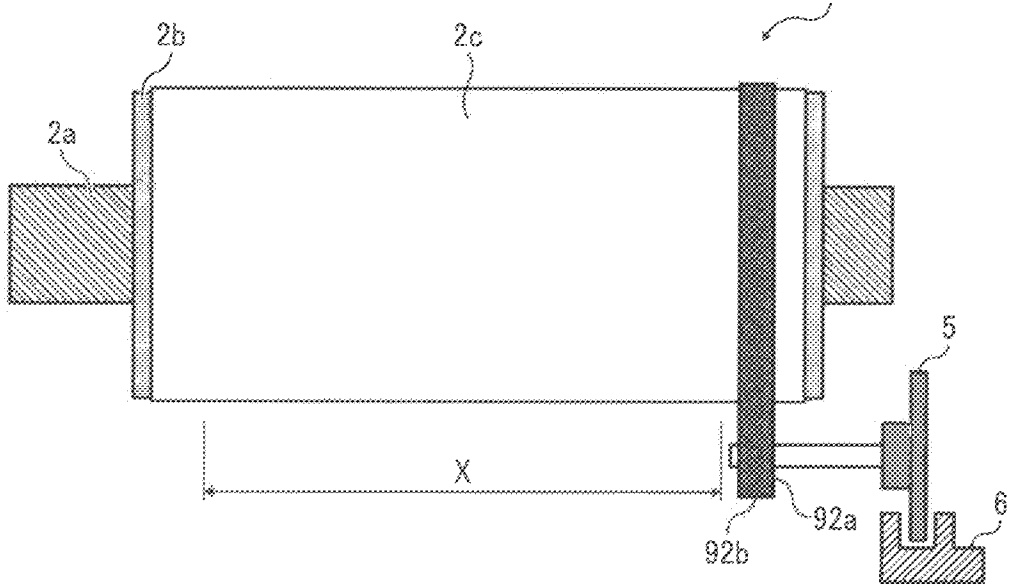
FIG. 4B is a side view of the fixing device illustrated in FIG. 4A.
Figure 4A:
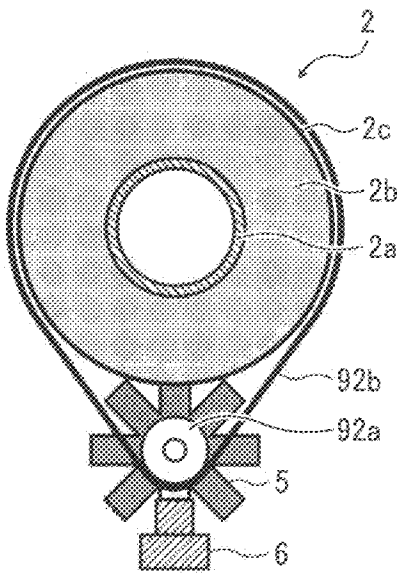
FIG. 4A is a front view of a second configuration example of the fixing device having the rotation detector to detect rotation of the fixing sleeve.

FIG. 4A is a front view of a second configuration example of the fixing device having the rotation detector to detect rotation of the fixing sleeve. FIG. 4B is a side view of the fixing device illustrated in FIG. 4A.

In such a configuration, the fixing sleeve 2*c* is adhered to the outer circumferential surface of the elastic layer 2*b*, and the rotary belt 92*b* made of, e.g., rubber is looped around a portion of the outer circumferential surface of the auxiliary roller 92*a* and an end portion of the fixing sleeve 2*c* outside of the area X of maximum image size. The rotary belt 92*b* is rotated with the rotation of the fixing sleeve 2*c* by the frictional force between the fixing sleeve 2*c* and it, and the rotation force of the rotary belt 92*b* is transmitted to the auxiliary roller 92*a* to rotate the rotation detection bladed wheel 5 coaxially with the roller 92. Thus, a predetermined portion of the rotation detection bladed wheel 5 provided coaxially with the roller 92 passes through the rotation sensor 6 at constant time intervals, thus allowing the rotation of the fixing sleeve 2*c* to be detected with the rotation sensor 6.

Figure 5B:
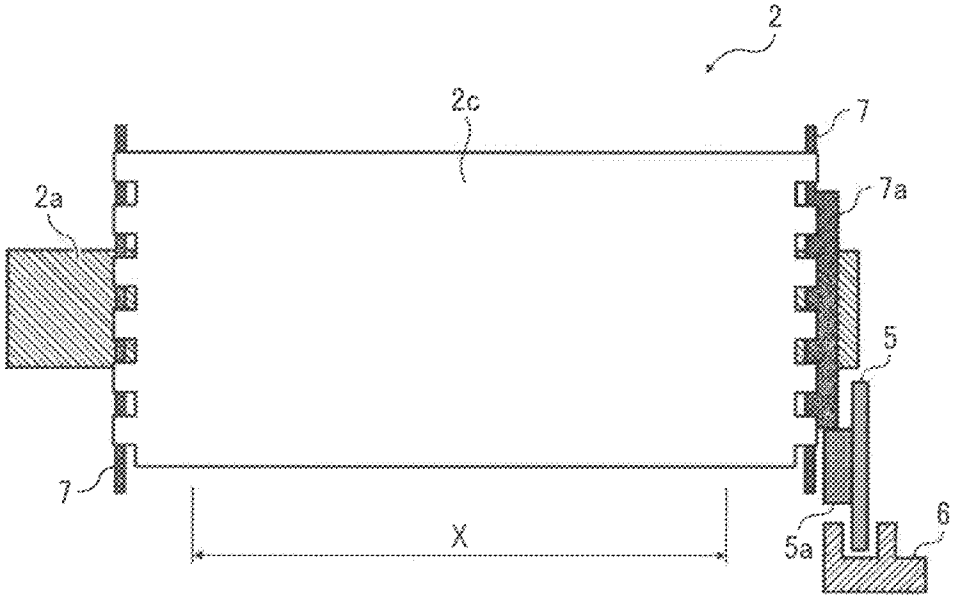
FIG. 5B is a side view of the fixing device illustrated in FIG. 5A.
Figure 5A:
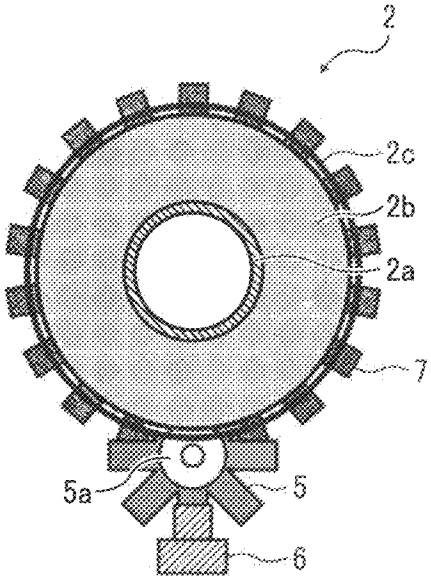
FIG. 5A is a front view of a third configuration example of the fixing device having the rotation detector to detect rotation of the fixing sleeve.

FIG. 5A is a front view of a third configuration example of the fixing device having the rotation detector to detect rotation of the fixing sleeve. FIG. 5B is a side view of the fixing device illustrated in FIG. 5A.

In this configuration, the fixing sleeve 2*c* is not adhered to the outer circumferential surface of the elastic layer 2*b* or the fixing member illustrated in FIG. 2B. Hence, a regulation ring 7 is provided at both end portions of the metal core 2 to limit the lateral shift of the fixing sleeve 2*c*. The regulation ring 7 is rotatable independently of the fixing roller or the fixing member held in a fixed manner. The outer circumference of the regulation ring 7 has a teeth shape in a spur gear form as illustrated in FIG. 5. The diameter of the addendum circle of the teeth shape of the regulation ring 7 is larger than the external diameter of the fixing sleeve 2*c* while the diameter of the dedendum circle is smaller than the internal diameter of the fixing sleeve 2*c*. Accordingly, if each end portion of the fixing sleeve 2*c* has the same teeth form as the teeth shape of the outer circumference of the regulation ring 7, each end portion of the fixing sleeve 2*c* engages with the outer circumference of the regulation ring. Accordingly, the regulation ring 7 is rotated in synchronization with the rotation of the fixing sleeve 2*c*, and the rotation of the regulation ring 7 is transmitted to another rotary member via, for example, a transmission mechanism including a combination of a gear 7*a* integrally formed with the regulation ring 7 and the gear 5*a* integrally formed with the rotation detection bladed wheel 5. A predetermined portion of the rotation detection bladed wheel 5 passes through the sensor 6 with a constant interval of time, thus allowing the rotation of the fixing sleeve 2*c* to be detected with the rotation sensor 6.

The above-described rotation detector includes, for example, a photosensor (rotation sensor 6) serving as an optical sensor. The rotation sensor 6 has a detection unit including a light emitter to emit detection light and a light receiver to receive the detection light. The rotation detection bladed wheel 5 is sandwiched between the light emitter and the light receiver to get into the detection unit of the rotation sensor 6. The rotation detection bladed wheel 5 is rotated by the rotation of the fixing sleeve 2*c* (3*c*). For example, every time each space between blades passes through the detection unit, the light receiver detects the detection light, thus allowing detection of the rotation of the fixing sleeve 2*c* (3*c*). When the rotation sensor 6 detects the rotation of the rotation of the fixing sleeve 2*c* (3*c*), the rotation sensor 6 sends signals corresponding to the detection to a control unit.

Figure 6A:
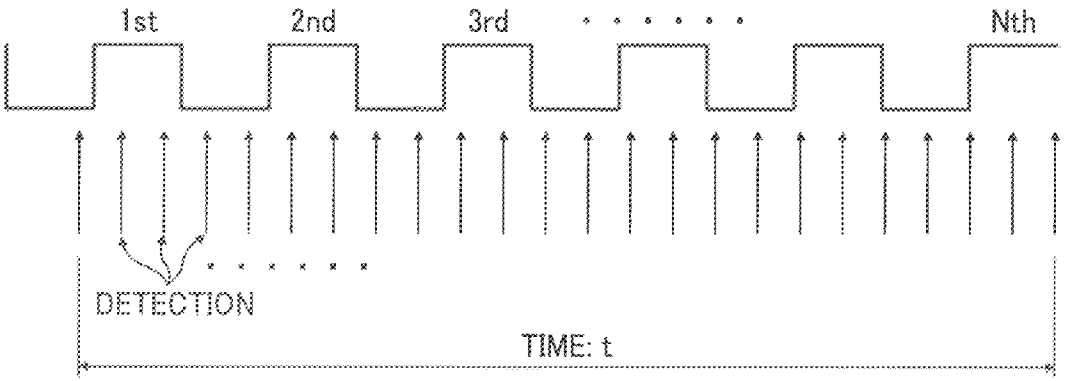
FIG. 6A is an example of a timing chart obtained when the rotation detector detects normal rotation of the fixing sleeve.
Figure 6B:
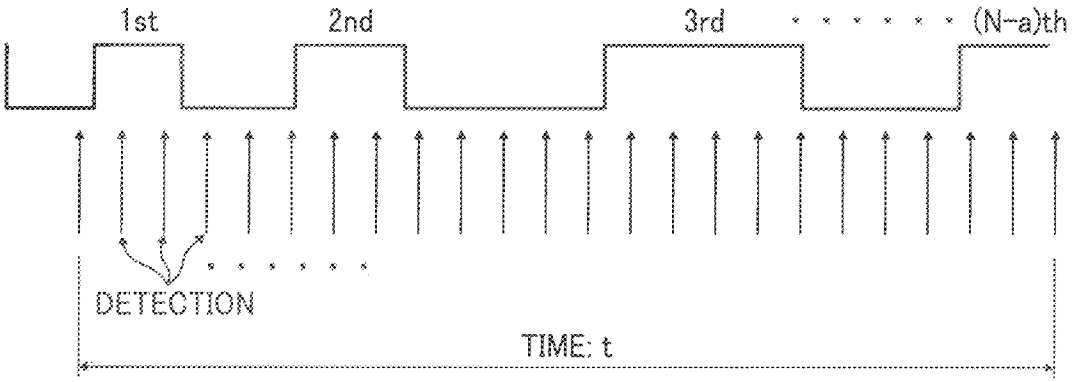
FIG. 6B is an example of a timing chart obtained when the rotation detector detects faulty rotation of the fixing sleeve.

FIG. 6A is an example of a timing chart obtained when the rotation detector detects normal rotation of the fixing sleeve. FIG. 6B is an example of a timing chart obtained when the rotation detector detects faulty rotation of the fixing sleeve.

The rotation detector counts the number of times each blade of the rotation detection bladed wheel 5 passes through the rotation sensor 6. In this configuration, the detection time range is set at t seconds. When rectangular waves are generated n times in t seconds, it is determined to be normal (FIG. 6A). When rectangular waves are generated only (n-a) times in t seconds, it is determined to be faulty (FIG. 6B). When the rotation detector detects faulty rotation, the rotation detector causes the control unit to stop the operation of the heating unit (immediately power off the heating unit). Alternatively, if the rotation cannot be detected for "a" times or more when the rotation detector detects the rotation "n" times in t seconds, the rotation detector stops the operation of the heating unit (immediately power off the heating unit). In this case, parameters, i.e., "t" seconds, "n" times, and "a" times, are different depending on the configurations of the image forming apparatus and the fixing device.

In the image forming apparatus having the thermal fixing device, when such a malfunction is found using the rotation detector, the heating unit (the heat source, such as the induction heater or the halogen heater) is immediately powered off. Such a configuration prevents the fixing sleeve to be heated to a temperature more than an allowable temperature limit of the fixing sleeve.

Numerous additional modifications and variations are possible in light of the above teachings. It is therefore to be understood that within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A thermal fixing device, comprising:

a fixing member;

a flexible endless belt disposed on an outer circumferential surface of the fixing member;

a rotary pressure member disposed parallel to and pressing against the fixing member via the endless belt;

a heater to heat the endless belt; and a rotation detector to detect a rotation speed of the endless belt, wherein the rotation detector comprises an auxiliary roller disposed away from the endless belt and a rotary belt looped around the auxiliary roller and the outer circumferential surface of the endless belt outside an area of maximum image size in an axial direction of the endless belt, and detects a rotation speed of the auxiliary roller, wherein the heater is powered off when the rotation speed of the auxiliary roller detected by the rotation detector is at or below a predetermined threshold value, wherein the rotation detector further comprises:

a rotation detection bladed wheel provided coaxially with the auxiliary roller; and a sensor, wherein the rotation detector detects the rotation speed of the auxiliary roller by detecting with the sensor that a portion of the rotation detection bladed wheel passes through the sensor.

2. The fixing device according to claim 1, wherein the endless belt is an integral part of the fixing member and rotated by rotation of the fixing member.

3. The fixing device according to claim 1, wherein the endless belt is formed separately from the fixing member and rotated by rotation of the fixing member.

4. The fixing device according to claim 1, wherein the endless belt is formed separately from the fixing member and rotated by rotation of any member other than the fixing member while sliding over the outer circumferential surface of the fixing member.

5. An image forming apparatus comprising a fixing device, the fixing device comprising:

a fixing member;

a flexible endless belt disposed on an outer circumferential surface of the fixing member;

a rotary pressure member disposed parallel to and pressing against the fixing member via the endless belt;

a heater to heat the endless belt; and a rotation detector to detect a rotation speed of the endless belt, wherein the rotation detector comprises an auxiliary roller disposed away from the endless belt and a rotary belt looped around the auxiliary roller and the outer circumferential surface of the endless belt outside an area of maximum image size in an axial direction of the endless belt, and detects a rotation speed of the auxiliary roller, wherein the heater is powered off when the rotation speed of the auxillary roller detected by the rotation detector is at or below a predetermined threshold value, wherein the rotation detector further comprises:

a rotation detector bladed wheel provided coaxially with the auxillary roller; and a sensor, wherein the rotation detector detects the rotation speed of the auxiliary roller by detecting with the sensor that a portion of the rotation detection bladed wheel passes through the sensor.

6. A thermal fixing device, comprising:

a fixing member;

a flexible endless belt disposed on an outer circumferential surface of the fixing member;

a rotary pressure member disposed parallel to and pressing against the fixing member via the endless belt;

a heater to heat the endless belt; and a rotation detector to detect a rotation speed of the endless belt, wherein the heater is powered off when the rotation speed of the endless belt detected by the rotation detector is at or below a predetermined threshold value, wherein the rotation detector comprises a rotary member rotated by rotation of the endless belt, and detects the rotation speed of the endless belt by detecting rotation of the rotary member, wherein the endless belt is an integral part of the fixing member and rotated by rotation of the fixing member, and the endless belt is adhered to an inner component of the fixing member which is disposed at an inner circumferential surface of the endless belt, wherein the rotation detector further comprises:

a rotation detection bladed wheel; and a sensor, wherein the rotation detector detects the rotation speed by detecting with the sensor that a portion of the rotation detection bladed wheel passes through the sensor.

* * * * *